US008618396B1

(12) United States Patent
Dunnett

(10) Patent No.: US 8,618,396 B1
(45) Date of Patent: Dec. 31, 2013

(54) MODULAR CONCERT DRUM THROW

(76) Inventor: Ronn Dunnett, Delta (CA)

( * ) Notice: Subject to any disclaimer, the term of this patent is extended or adjusted under 35 U.S.C. 154(b) by 35 days.

(21) Appl. No.: 13/474,465

(22) Filed: May 17, 2012

Related U.S. Application Data

(60) Provisional application No. 61/487,129, filed on May 17, 2011.

(51) Int. Cl.
*G10D 13/02* (2006.01)

(52) U.S. Cl.
USPC ..... 84/415

(58) Field of Classification Search
USPC ..... 84/415
See application file for complete search history.

(56) References Cited

U.S. PATENT DOCUMENTS

| | | | | | |
|---|---|---|---|---|---|
| 1,653,570 | A | * | 12/1927 | Howe | 84/173 |
| 2,261,120 | A | * | 11/1941 | Ludwig et al. | 84/415 |
| 2,274,435 | A | | 2/1942 | Slingerland | |
| 2,433,200 | A | * | 12/1947 | Cordes | 84/415 |
| 4,079,657 | A | | 3/1978 | Sobreira | |
| 4,138,920 | A | | 2/1979 | Meador | |
| 4,339,982 | A | | 7/1982 | Hoshino | |
| 5,107,742 | A | | 4/1992 | Cummings et al. | |
| D340,254 | S | * | 10/1993 | Yamashita | D17/22 |
| 5,557,053 | A | | 9/1996 | Nickel | |
| 5,559,296 | A | * | 9/1996 | Yamashita | 84/415 |
| 6,020,547 | A | | 2/2000 | Chen | |
| 6,093,877 | A | | 7/2000 | Nickel | |
| 6,172,288 | B1 | * | 1/2001 | Freer | 84/411 R |
| 7,223,910 | B2 | * | 5/2007 | Shimada | 84/415 |
| 7,262,355 | B2 | | 8/2007 | Hagiwara et al. | |
| D564,012 | S | | 3/2008 | Montineri | |
| 7,745,712 | B2 | | 6/2010 | Dunnett | |
| 8,350,139 | B2 | * | 1/2013 | Lutz et al. | 84/415 |
| 2002/0083817 | A1 | | 7/2002 | Hoshino | |
| 2004/0065185 | A1 | | 4/2004 | Hagiwara | |
| 2004/0168563 | A1 | | 9/2004 | Dorfman et al. | |
| 2005/0188818 | A1 | | 9/2005 | Okamoto | |
| 2005/0223875 | A1 | | 10/2005 | Hagiwara et al. | |

* cited by examiner

*Primary Examiner* — Robert W Horn
(74) *Attorney, Agent, or Firm* — Dwayne E. Rogge; Schacht Law Office, Inc.

(57) ABSTRACT

The modular throw assembly disclosed herein comprises a plurality of throws comprising lever arms positionably mounted upon a single shaft. In one form, the lever arms are allowed to slide longitudinally along a portion of the shaft while the lever arms are in the released position, but are may be less likely to be longitudinally repositioned when in the tensioned position as the tension of the snare set will produce sufficient friction to hinder longitudinal sliding. In other embodiments, a setscrew or other component may be utilized to fix the position of each lever arm along the axis of the shaft. In another embodiment, narrow or wide spacers may alternatively be provided between each adjacent lever arm to provide this spacing between adjacent lever arms.

6 Claims, 9 Drawing Sheets

MODULAR CONCERT DRUM THROW

RELATED APPLICATIONS

This application claims priority benefit of U.S. Ser. No. 61/487,129, filed May 17, 2011.

BACKGROUND OF THE DISCLOSURE

Field of the Disclosure

This application relates to the field of snare drum throws for snare drums having a plurality of interoperating snare sets attached thereto.

SUMMARY OF THE DISCLOSURE

A modular throw for a snare drum, the modular throw comprising a shaft coupled to the outer wall of a snare drum where a major axis of the shaft is substantially normal to with a radius of the snare drum. A plurality of snare drum throws may be coupled to the shaft so as to rotate thereabout, each snare drum throw comprising at least one lever arm, having an upper end comprising a user engagement portion, and a lower end pivotably coupled to the shaft. A swing arm having an upper end pivotably coupled to the lever arm, a middle section forward of the shaft, and a lower end comprising a snare set attachment device for attachment to a first end of a cooperating snare set. In one form, a line extending between a center of the lever arm/swing arm pivot and the snare set attachment device passes rearward of a center of the shaft. Each drum throw comprises a tensioned position wherein the cooperating snare set is tensioned; and each drum throw comprises a released position wherein the cooperating snare set is not tensioned, and the snare set will not substantially contact the drum when the drum is struck.

The modular throw for a snare drum as disclosed may further comprise a master tension adjustment mechanism coupled to the shaft, and configured to reposition the shaft relative to the snare drum for fine tension adjustment of the snare set.

The modular throw for a snare drum as disclosed may further comprise a master throw assembly coupled between the shaft and the snare drum; and configured to reposition the shaft relative to the snare drum for gross repositioning of the snare set to allow the snare set to selectively contact the snare drum.

The modular throw for a snare drum as disclosed may further comprise a master throw assembly coupled between the shaft and the snare drum. The master throw assembly configured to reposition the shaft relative to the snare drum for gross repositioning of the snare set to allow the snare set to selectively contact the snare drum.

The modular throw for a snare drum as disclosed may further comprise at least one wide spacer positioned upon the shaft, and having substantially the same width as an adjacent drum throw. The modular throw for a snare drum as disclosed may be arranged wherein the wide spacer is positioned between adjacent drum throws to provide a visual and tactile separation between the drum throws.

DESCRIPTION OF THE PREFERRED EMBODIMENTS

Snare drums and snare drum throws or strainers are common in the art of percussion instruments. Often snare drums are used in orchestras, marching bands and concert bands, drum kits and many other musical applications.

Snare drums are often the centre of the drum kit, the most prominent drum in most marching and stage bands, and the drum that percussion instrument students learn to play first.

The snare drum is most commonly double-headed, with rattles (commonly called snares, or snare sets) of gut, metal wire or synthetics stretched across one or both heads. There are three common patterns:

- In most applications, a single snare set is applied to the bottom of the bottom (unplayed) head. Orchestral and drum kit players often use extremely thin, specialized snare drum heads on the bottom head. These thin bottom heads are commonly too light to be struck directly.
- Pipe band side drums may have a second snare set on the bottom (inside) of the top (played or batter) head, as well as a snare set on the bottom of the bottom head.
- Other drum styles may utilize a single snare set on the top of the top head. Occasionally these drums omit the bottom head altogether.

Many modern snare drums have an adjustable snare throw or strainer which allows the snare set to be released completely, creating an effect similar to a tom-tom drum. One such throw with an improved detachment system is disclosed in U.S. Pat. No. 7,745,712 ('712) incorporated herein by reference for supporting information.

Different types of snare drums can be found, like Piccolo snares, that have a smaller depth for a higher pitch, rope-tuned snares (Maracatoo snare) and the Brazilian "Taro)", that commonly has snares on the top of the upper drumhead. The snare drum is often considered one of the most important drums of the drum kit.

Historically, snare drums have been used in military and parading bands to produce drum cadences. Today in popular music, especially with rock drum kits, the snare drum is very common.

Often a different snare set is desired than the snare set attached to the drum, for example when a spring wire snare set is in use and a gut or nylon snare set is desired. The most common way to replace the assembly is to release the throw, remove the snare set attached to the drum, attach the new snare set, and then re-tune the drum. The '712 patent is a good example of a quick and easy way to change out (remove and replace) such snare sets. U.S. Pat. No. 5,559,296 (incorporated herein by reference) discloses an alternate method, where multiple independent throws are attached adjacent to each other, and each independent throw is attached to a separate snare set. As each throw has separate attachment points to the drum wall, and as each throw has significant longitudinal (circumferential) width, there are disadvantages to this design.

Figure 1:
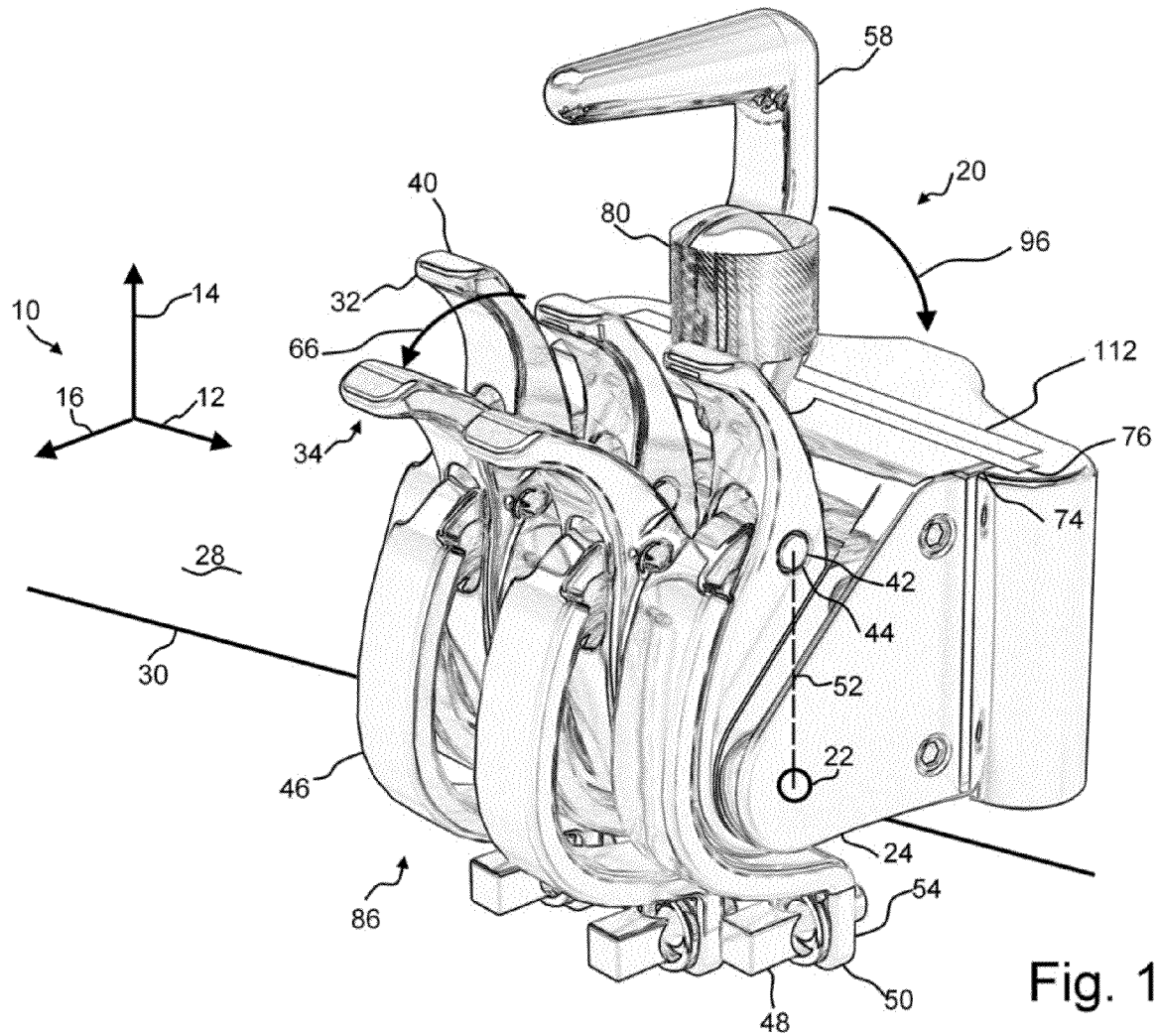
FIG. 1 is an isometric view of a plurality of five throw handles, with two handles in the released position.
Figure 2:
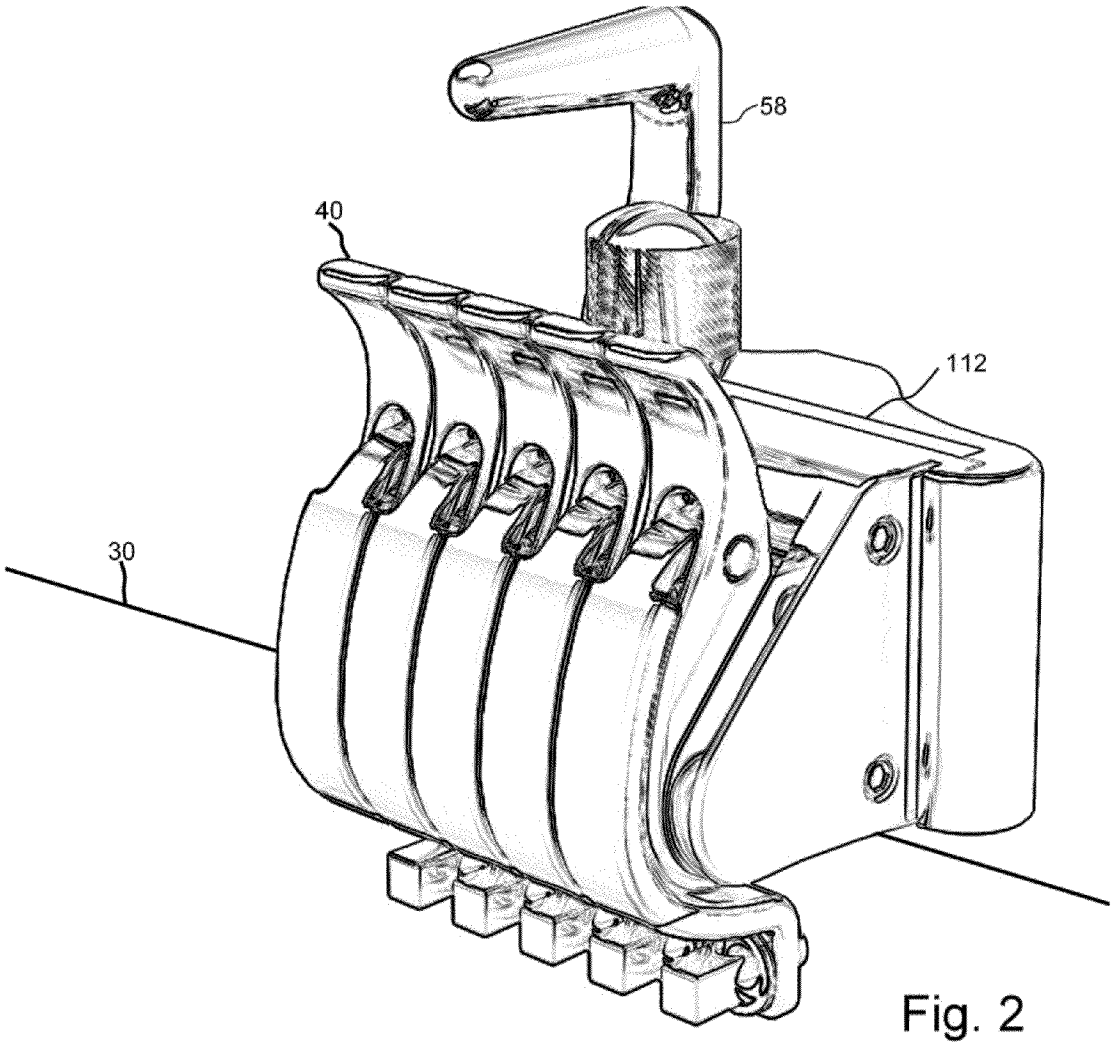
FIG. 2 is an isometric view of the embodiment of FIG. 1 with all of the handles in the upright position.
Figure 3:
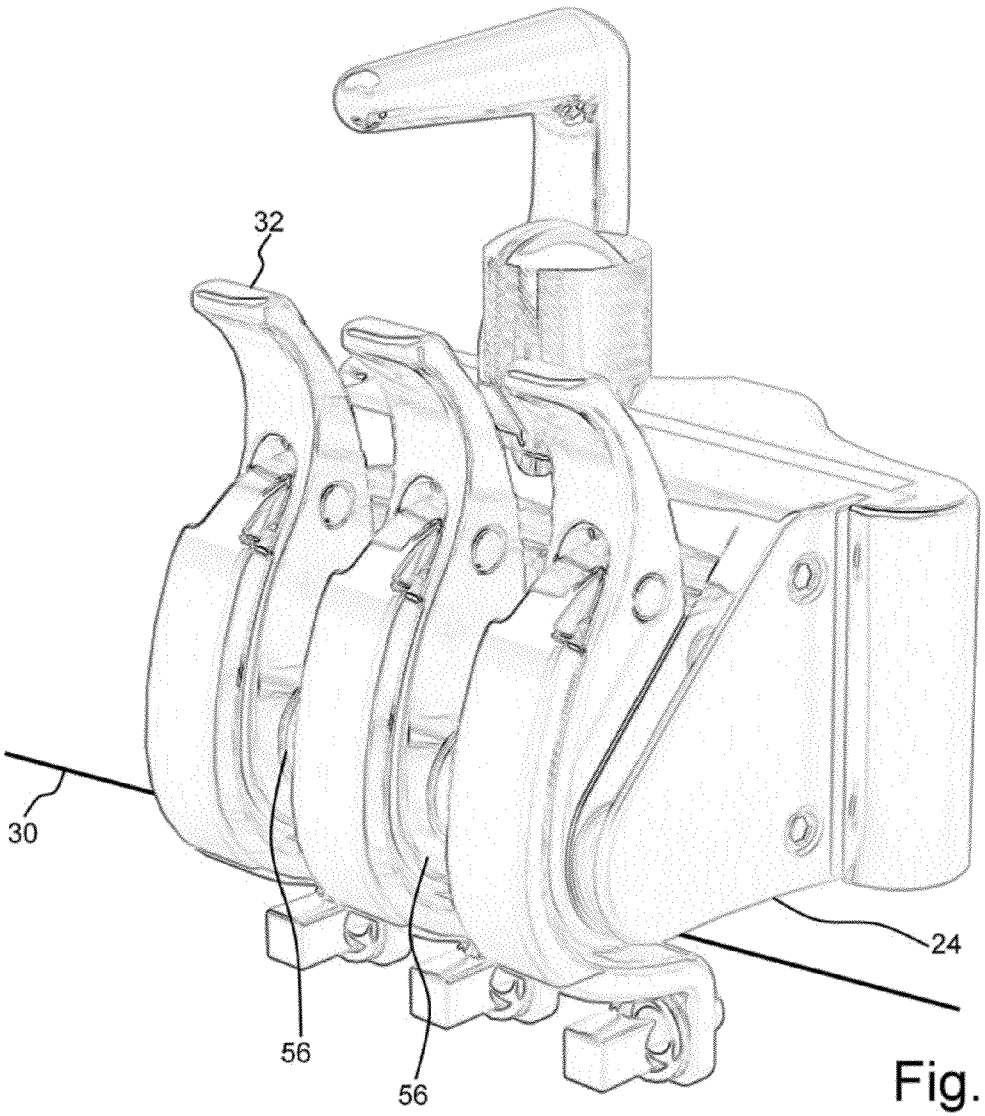
FIG. 3 is a highly schematic isometric view similar to that of FIG. 1 but from a slightly different angle.

Before beginning a detailed description, an axes system 10 is disclosed as shown in FIG. 1. The axes system 10 comprises a vertical axis 14, a longitudinal axis 12, and a transverse axis 16. The longitudinal axis 12 is generally tangential to the outer diameter of the drum. The vertical axis is generally aligned with the major axis of the drum, drums generally being cylindrical about a central axis. The transverse axis 16 is generally normal to both the vertical and the longitudinal axes. These axes are included herein for reference purposes only and are not intended to limit the scope of the disclosure.

Looking to FIG. 1, one embodiment of a modular concert drum throw assembly 20 is shown, comprising a shaft 22 supported on either end by support posts 24 and 26, which in one form are coupled through the shaft and a master throw assembly and/or master adjustment assembly to the outer wall of a drum 28 near the bottom, radially outward edge 30.

Unlike prior art throw assemblies, the modular throw assembly disclosed herein comprises a plurality of interoperating throws 86 each comprising a separate lever arm 32 which are all mounted upon a single shaft 22. In one form, the throws are positionably attached to the shaft 22 as will be described.

Figure 7:
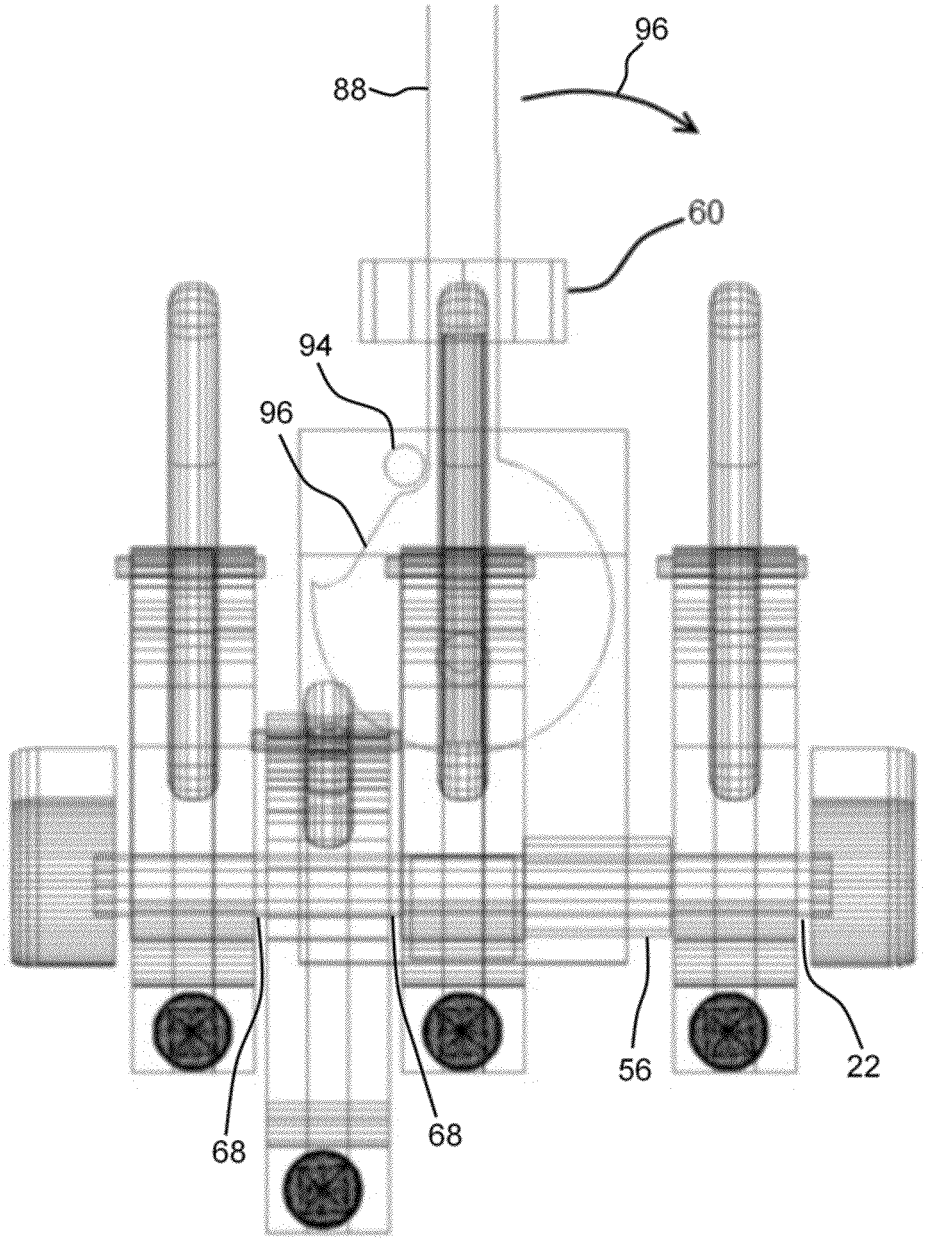
FIG. 7 is a front view of the embodiment of FIG. 5.
Figure 8:
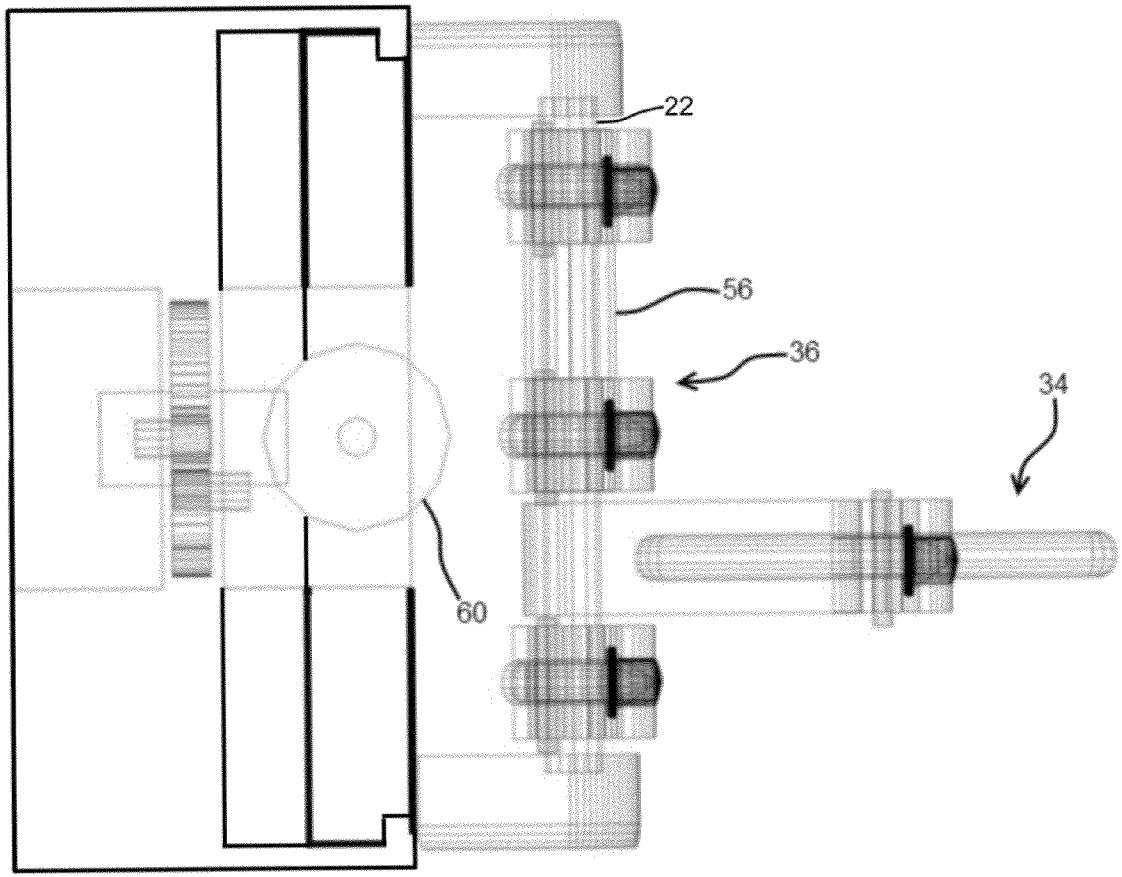
FIG. 8 is a highly schematic wireframe top view of the embodiment of FIG. 5.

In one form, the throws 86 are attached to the shaft so as to slide longitudinally along the shaft 22 between the support posts while the lever arms are in the released position 34, but the throws 86 may be substantially prohibited from longitudinally repositioning when the throws are in the tensioned position 36, as the tension of the attached snare set will produce sufficient friction between the throws and the shaft to hinder longitudinal sliding of the throws upon the shaft. In other embodiments, such as that shown in FIG. 5, a setscrew 64 or other component may be utilized to fix the position of each lever arm 32 along the shaft 22. The set screw could be threaded into the lower portion of the lever arm, and frictionally engage a surface of the shaft. A groove or raised portion may be provided on the shaft to prohibit the lever arm from rotating beyond a specified range of motion. In another embodiment as shown in FIG. 7, narrow spacers 68 may be provided between each adjacent lever arm 32 to provide spacing between adjacent lever arms.

Figure 5:
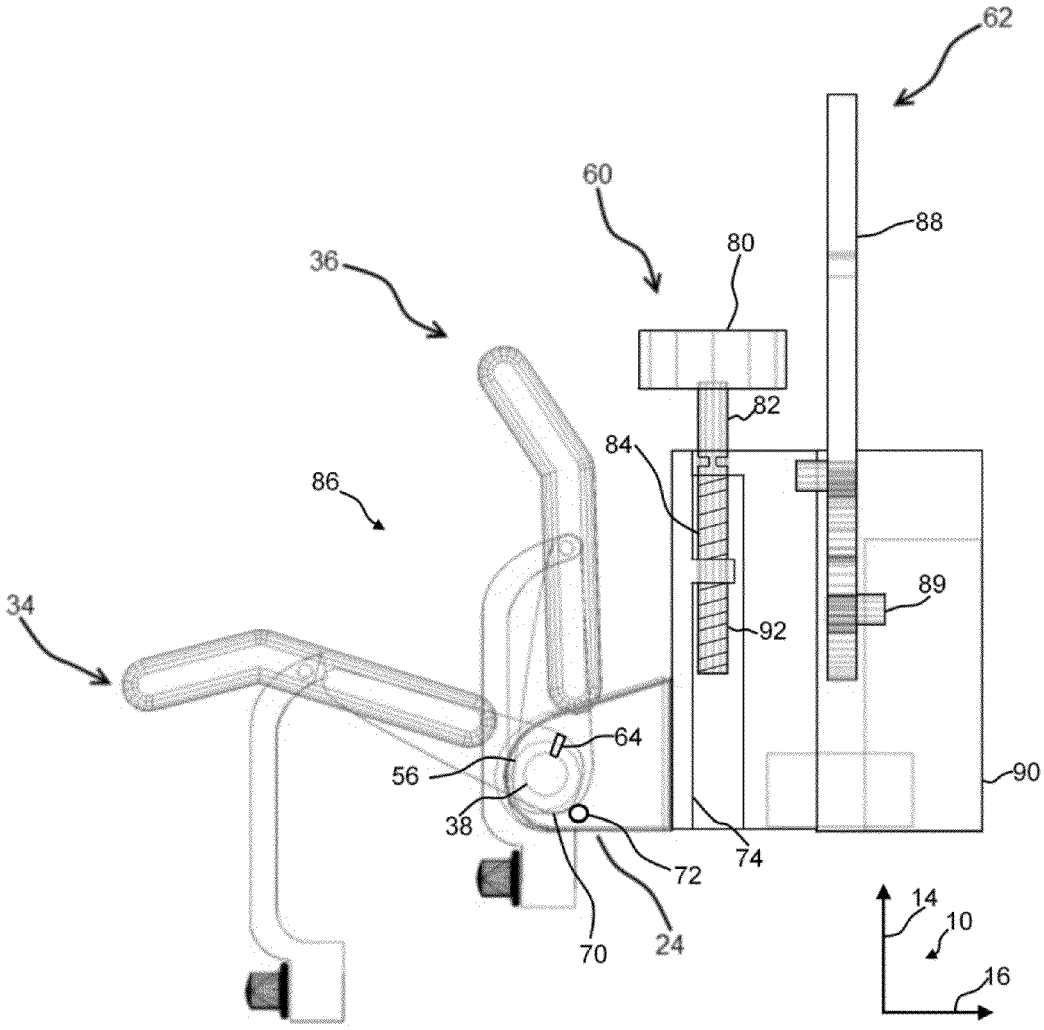
FIG. 5 is a highly schematic side partial hidden line view of the embodiment of FIG. 1 further incorporating a master quick release lever of a different embodiment from that shown in FIG. 4 and master tension adjustment.
Figure 6:
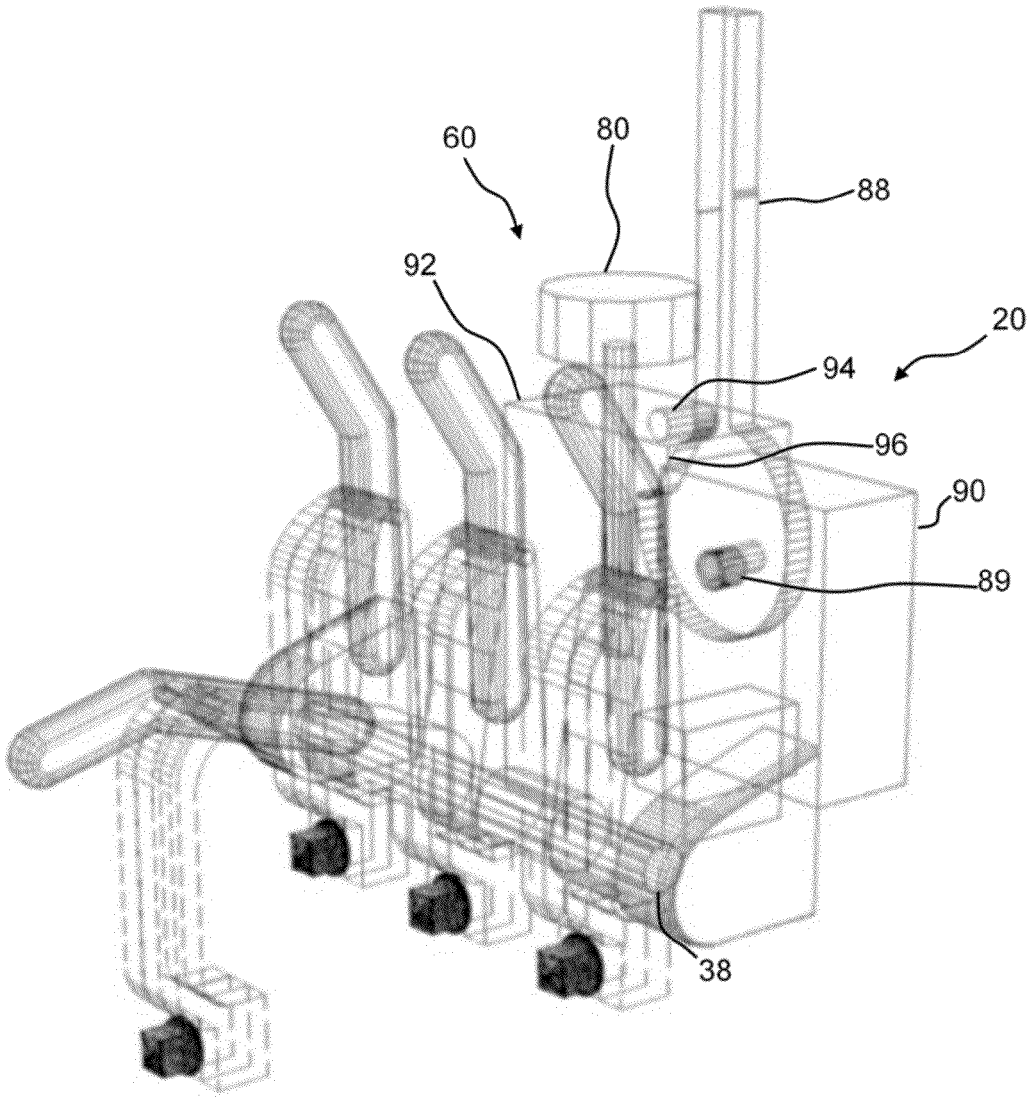
FIG. 6 is a wireframe isometric view of the embodiment of FIG. 5.
Figure 9:
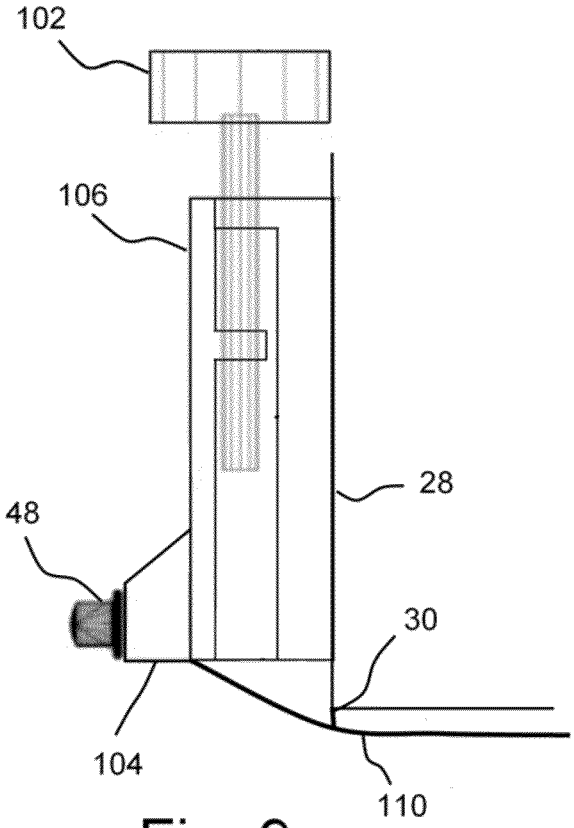
FIG. 9 is a highly schematic cutaway view of one embodiment of a snare set and butt end adjustment mechanism.

In one embodiment, each of the lever arms 32 comprises an opening 38 through which the shaft 22 passes as shown in FIGS. 5 and 6. Each of the lever arms may also comprise a drummer engagement portion 40 or handle, which in this embodiment is shown at the opposing end of the lever arm 32 from the opening 38. In one form, a pivot 42 is provided between the drummer engagement portion 40 and the opening 38 upon each lever arm 32. The pivot 42 in one embodiment comprises a pivot pin 44 passing through a hole in the lever arm 32, and also passing through a hole in a swing arm 46. At the opposing end of the swing arm 46 is a snare bolt 48 or equivalent apparatus configured to attach the lower end 50 of the swing arm 46 to a first end of a snare set. The snare bolt 48 forming one embodiment of a snare set attachment device. Many other snare set attachment devices may be used, such as the attachment devices shown in the '712 patent. One such snare set 110 is shown in FIG. 9. By this arrangement wherein a line extending between a center of the lever arm/swing arm pivot and the snare set attachment device passes rearward of a center of the shaft, the swing arm is held in place when the snare set is tensioned. This orientation is used for reference, and the device would of course operate if the drum and throw assembly were rotated, as is especially common in marching bands.

Thus, this embodiment of the snare drum throw functions as a cam arm, and when the pivot 42 is rotated past a vertical line 52 (top dead center) between the axial center of the shaft 22, and the rear surface 54 of the lower end of the swing arm at which the snare set will attach. In this way, downward force exerted by the snare set maintains the lever arm 32 in the tensioned position 36 until the drummer engages and releases the throw.

In one form, as shown in FIG. 5, a surface of a protrusion 70 of the lever arms 32 may be configured to engage a surface of a protrusion or stop 72 on the shaft, drum wall, support posts, or other surface to prohibit the lever arms 32 from rotating beyond the released position shown in FIG. 1.

Figure 4:
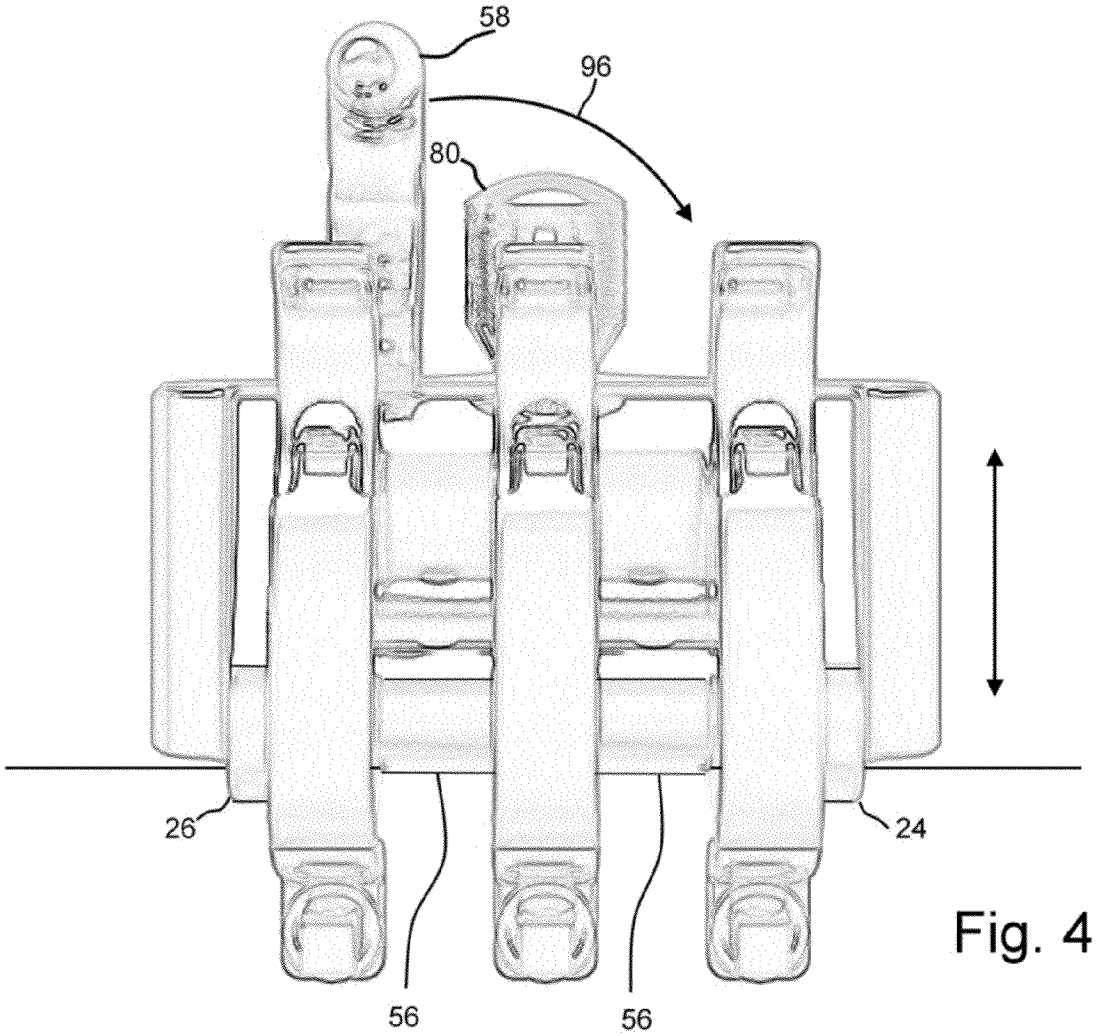
FIG. 4 is a highly schematic isometric view of the embodiment shown in FIG. 1 further incorporating a master snare drum throw and master tension adjustment.

In one embodiment, a wide spacer 56 such as shown in FIG. 4 may be provided. The wide spacer 56 is positioned between adjacent lever arms such as where a lever arm may be omitted as in FIG. 7, either on a temporary or permanent basis. One significant advantage of this arrangement over prior art designs is that the lever arms 32 may be grouped or repositioned as a subset. Such an arrangement may be utilized to differentiate the throws or groups of throws, which may be attached to snare set of different timbers or different materials. For example, it may be desired to have one throw attached to a metallic spring snare set, whereas other throws may be attached to gut snare sets of varying timbers. This is just one example of differentiated or grouped snare sets, and other configurations are possible including configurations of one, two, three, five, or more levers.

In another embodiment, a master throw assembly 62 and master tension adjustment 60 may be utilized to interconnect the entire row of lever arms 32 or alternatively a subset of the lever arms. While the lever arms 32 may be configured to be thrown separately, the master throw assembly 62 may function to release or tension the entire set or a subset of the lever arms 32 simultaneously, with the actuation of a single device. Similarly the lever arms 32 may be configured to be adjusted separately, the master adjustment assembly 60 may function to adjust the entire set or a subset of the lever arms 32 simultaneously, with the actuation of a single device.

In one embodiment, as individual adjustment of the snare sets may be desired, a butt end snare adjustment assembly 100 may be attached to the drum 28 and coupled to receive the opposite end of the snare set from the end of the snare set attached to the modular throw assembly 20. The master tension adjustment mechanism disclosed herein may be modified as shown in FIG. 9. And generally comprise a snare bolt 48, which repositions vertically relative to the bottom edge 30 of the snare drum as a tension adjustment knob 102 is rotated in a similar manner to that described below relative to the master tension adjustment. As the tension adjustment knob is actuated a front portion 106 repositions, and a butt end snare set attachment portion 104, including the snare bolt 48 translates vertically to adjust the individual snare set 110 attached thereto. Such a butt end snare adjustment could be provided on each snare set to allow for independent adjustment of each snare set.

In the embodiment shown in a highly schematic manner in FIG. 5, the master tension adjustment 60 may be structurally positioned between a master throw assembly 62 and the support posts 24/26. In this embodiment, the back sides of the support posts 24 are attached to a forward portion 74 of the master tension adjustment 60. The adjustment knob 80 in one form comprises a shaft 82 which when actuated, vertically repositions the forward portion 74 relative to the rear portion 76 for adjustment of the attached throws 86 and attached snare sets. Such tension adjustments are known, such as shown in FIG. 6 of U.S. Pat. No. 7,301,087 ('087) incorporated herein by reference.

In one form, the shaft 82 and either one or both of the forward portion 74 and rearward portion 76 comprise a threaded portion 92 such that rotation of the shaft relative to the forward portion 74 results in vertical movement of the forward portion 74 relative to the rearward portion 76. The forward portion 74 and rearward portion 76 may comprise a dovetail, tongue and groove, or other attachment to maintain lateral and transverse positioning of the forward portion 74 relative to the rearward portion 76. One such sliding joint is shown in FIG. 1. Such sliding joints of many different configurations are well known. Other such tension adjustments are known, such as the sliding joint shown in FIG. 7 of the '087 patent.

In one form, the master throw assembly 62 and master throw switch comprise a lever arm 88 which repositions (rotates) about a pivot 89 relative to a support block 90 in direction of travel 96 into groove 112. The rearward portion 76 of the master tension adjustment system 60 repositions vertically with relation to a portion of the lever arm 88 comprises a cam surface. The support block 90 and intermediate member 98 may comprise a sliding dovetail joint, tongue and groove, or other linearly positionable joint. Such sliding joints are used to maintain lateral and transverse positioning of the support block 90 relative to the intermediate member wile allowing linear, vertical movement. As previously presented, such sliding joints of many different configurations are well known.

Of course, the relative placement of the master tension adjustment 60 and master throw assembly 62 may be reversed such that the master tension adjustment is proximal to the drum 28, and the master throw is distal from the drum 28.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A modular throw for a snare drum, the modular throw comprising:

a. a shaft coupled to the outer wall of a snare drum where a major axis of the shaft is substantially normal to with a radius of the snare drum;

b. a plurality of snare drum throws coupled to the shaft so as to rotate thereabout, each snare drum throw comprising;

i. a lever arm having an upper end comprising a user engagement portion, and a lower end pivotably coupled to the shaft;

ii. a swing arm having an upper end pivotably coupled to the lever arm, a middle section forward of the shaft, and a lower end comprising a snare set attachment device for attachment to a first end of a cooperating snare set;

iii. wherein a line extending between a center of the lever arm/swing arm pivot and the snare set attachment device passes rearward of a center of the shaft;

c. wherein each drum throw comprises a tensioned position wherein the cooperating snare set is tensioned; and d. wherein each drum throw comprises a released position wherein the cooperating snare set is not tensioned, and the snare set will not substantially contact the drum when the drum is struck.

2. The modular throw for a snare drum as recited in claim 1 further comprising a master tension adjustment mechanism coupled to the shaft, and configured to reposition the shaft relative to the snare drum for fine tension adjustment of the snare set.

3. The modular throw for a snare drum as recited in claim 2 further comprising a master throw assembly coupled between the shaft and the snare drum; and configured to reposition the shaft relative to the snare drum for gross repositioning of the snare set to allow the snare set to selectively contact the snare drum.

4. The modular throw for a snare drum as recited in claim 1 further comprising a master throw assembly coupled between the shaft and the snare drum; and configured to reposition the shaft relative to the snare drum for gross repositioning of the snare set to allow the snare set to selectively contact the snare drum.

5. The modular throw for a snare drum as recited in claim 1 further comprising at least one wide spacer positioned upon the shaft, and having substantially the same width as an adjacent drum throw.

6. The modular throw for a snare drum as recited in claim 5 wherein the wide spacer is positioned between adjacent drum throws to provide a visual and tactile separation between the drum throws.

* * * * *